US011338346B2

(12) United States Patent
Avrillaud et al.

(10) Patent No.: US 11,338,346 B2
(45) Date of Patent: May 24, 2022

(54) ELECTROHYDRAULIC FORMING DEVICE

(71) Applicant: ADM28 S.ÀR.L, Luxembourg (LU)

(72) Inventors: Gilles Avrillaud, Pinsaguel (FR); Julien Deroy, Toulouse (FR); Romain Pecquois, Toulouse (FR); Pierre Thouet, Montberon (FR)

(73) Assignee: ADM28 S.ÀR.L, Luxembourg (LU)

( * ) Notice: Subject to any disclaimer, the term of this patent is extended or adjusted under 35 U.S.C. 154(b) by 333 days.

(21) Appl. No.: 16/484,734

(22) PCT Filed: Feb. 8, 2018

(86) PCT No.: PCT/EP2018/053214
§ 371 (c)(1),
(2) Date: Aug. 8, 2019

(87) PCT Pub. No.: WO2018/146216
PCT Pub. Date: Aug. 16, 2018

(65) Prior Publication Data

US 2020/0001344 A1 Jan. 2, 2020

(30) Foreign Application Priority Data

Feb. 8, 2017 (FR) ..... 1751053

(51) Int. Cl.
*B21D 26/12* (2006.01)

(52) U.S. Cl.
CPC ..... *B21D 26/12* (2013.01)

(58) Field of Classification Search
CPC ..... B21D 26/12; B21D 26/06; B21D 26/02; B21D 26/00; B21D 26/031; B21D 26/021
See application file for complete search history.

(56) References Cited

U.S. PATENT DOCUMENTS 4,068,514 A 1/1978 Chachin et al.
7,802,457 B2 9/2010 Golovashchenko et al.
2015/0360273 A1* 12/2015 Lin ..... B21D 24/04 72/311

(Continued)

OTHER PUBLICATIONS

Knyazyev, M.K. et al. "Measurements of Pressure Fields with Multi-Point Membrane Gauges at Electrohydraulic Forming", 4th International Conference on High Speed Forming, 2010, pp. 75-82.

(Continued)

*Primary Examiner* — Teresa M Ekiert
(74) *Attorney, Agent, or Firm* — Seed Intellectual Property Law Group LLP

(57) ABSTRACT

An electrohydraulic forming device for forming a blank of material includes: —an electrohydraulic forming chamber, —at least one central electrode extending in a so-called longitudinal direction and comprising a first end arranged inside the electrohydraulic forming chamber, —a body provided with a bore for introducing each central electrode into the electrohydraulic forming chamber, the electrohydraulic forming chamber being partially formed by said body, —a mould, and —at least one peripheral electrode electrically insulated from each central electrode, arranged at a distance from and around the end of a central electrode, and extending in a transverse plane relative to said central electrode.

13 Claims, 4 Drawing Sheets

(56) References Cited

U.S. PATENT DOCUMENTS

| | | | | |
|---|---|---|---|---|
| 2015/0360275 | A1* | 12/2015 | Avrillaud ..... | B21D 22/30<br>72/56 |
| 2018/0021837 | A1 | 1/2018 | Avrillaud et al. | |

OTHER PUBLICATIONS

Eguia, I. et al. "Electrohydraulic Impact Forming of Deep Sheet Components with Complicated Local Elements", May 18-20, 2011, Brno, Czech Republic, EU, 6 pages.

* cited by examiner

ELECTROHYDRAULIC FORMING DEVICE

BACKGROUND

Technical Field

The present invention relates to an electrohydraulic forming device.

Description of the Related Art

Electrohydraulic forming makes it possible to deform a blank of material against a mould by applying a dynamic pressure. To this end, an electrical discharge is generated between at least two electrodes placed in a chamber filled with liquid, for example water. An electric arc is therefore formed between the two electrodes causing a high temperature gradient and the vaporisation of the liquid. A pressure wave, also commonly known as "shock wave", moves at high speed and presses the blank of material against the mould. Electrohydraulic forming is particularly advantageous in comparison with the other forming methods since it makes it possible to have a reduced springback and to obtain improved engraving type details and/or square edges and/or local elongations before rupture on the parts to be formed.

However, electrohydraulic forming has disadvantages. One of the disadvantages of electrohydraulic forming is that the electrodes wear rapidly. Therefore, the distance between the electrodes increases and the electrical discharge is weaker. The efficiency of the electrohydraulic forming reduces. In order to mitigate said disadvantage, the electrodes are replaced on a regular basis. The replacement of the electrodes incurs additional maintenance costs and involves a reduction of the rate of output following temporary immobilisation of the apparatus.

U.S. Pat. No. 4,068,514 describes an electrohydraulic forming device comprising a central electrode extending in a longitudinal direction and a peripheral electrode formed by the wall of the forming chamber surrounding the central electrode. The wear of the peripheral electrode being distributed over a larger surface, the distance between the electrodes varies less than with a device wherein two electrodes, the most often conical, are placed face to face and the active parts of which are therefore very localised.

Therefore, the electrodes can be used longer without the efficiency of electrohydraulic forming, and in particular the pressure generated by the shock wave, being affected. However, the replacement of an electrode involves the changing of the entire electrohydraulic forming chamber which incurs higher maintenance costs than for the other devices of the prior art and a longer temporary immobilisation of the apparatus for replacing the electrode.

BRIEF SUMMARY

The aim of the present invention in particular is to mitigate the disadvantages of the previously mentioned prior art.

To this end, the present invention proposes an electrohydraulic forming device for forming a blank of material comprising:

an electrohydraulic forming chamber, at least one so-called central electrode extending in a so-called longitudinal direction and comprising a first end arranged inside the electrohydraulic forming chamber, and at least one so-called peripheral electrode electrically insulated from each central electrode, having an end arranged at a distance from and around the end of a central electrode, said end extending in a transverse plane relative to said central electrode, a body provided with a bore for introducing each central electrode into the electrohydraulic forming chamber, the electrohydraulic forming chamber being partially formed by said body, and a mould.

Furthermore, each peripheral electrode is separate from said body.

According to the invention, the use of a peripheral electrode separate from the body partially forming the electrohydraulic forming chamber makes it possible to reduce the size of the peripheral electrode to be changed and the immobilisation time of the device when changing electrodes, thus reducing the maintenance costs.

In one embodiment, the at least one peripheral electrode is protruding relative to the body, which makes it possible to better control the location where the discharge occurs and increase the efficiency of the electrohydraulic forming.

In one embodiment, the at least one peripheral electrode is supported by an electrode holder.

The use of an electrode holder makes it possible to reduce the size of the peripheral electrode that must be changed and to simplify the replacement of the peripheral electrode. Advantageously, the electrode holder may also serve as a blank holder. Thus, a compact and easy to assemble electrohydraulic forming device is obtained.

In one embodiment, the device comprises a single peripheral electrode and at least one central electrode.

It may be advantageous to use a plurality of central electrodes combined with a single peripheral electrode, in particular in the case of parts to be formed of large dimensions. By producing a plurality of simultaneous or delayed electrical discharges at various locations, it is possible to produce electrohydraulic forming that is more homogeneous or more progressive or deeper than with an electrohydraulic forming device of the prior art. In other embodiments, the electrohydraulic forming device may comprise a plurality of pairs of central and peripheral electrodes combined with one or more moulds. Thus, it is possible to produce a plurality of parts in parallel or one large part by implementing at the same time a plurality of electrical discharges.

In one embodiment, the electrohydraulic forming chamber is formed by a body and by the end of the peripheral electrode. The electrohydraulic forming chamber is therefore sealed by the blank of material to be deformed. Said embodiment is advantageous because easy to machine and assemble.

In one embodiment, a blank of material is held between the end of the peripheral electrode and the mould. Thus, a compact and easy to assemble electrohydraulic forming device is obtained. Advantageously, the end of the peripheral electrode may comprise a shoulder wherein is lodged the blank of material. Therefore, the peripheral electrode serves as a blank holder and makes it possible to hold the blank of material against the mould.

In one embodiment, the device comprises a blank holder arranged between the end of the peripheral electrode and the mould.

In one embodiment, the device further comprises a mould support which makes it possible to change the mould more easily depending on the part to be formed.

In one embodiment, the central electrode is surrounded over a portion of the length thereof by an electrical insulator.

In another alternative embodiment, the body is in electrical contact with the central electrode and further comprises an electrical insulator for insulating the peripheral electrode of the central electrode.

When the central electrode is surrounded over a portion of the length thereof by an electrical insulator, the body is easier to machine and assemble than when the body comprises the electrical insulator for insulating the peripheral electrode of the central electrode.

Advantageously, the body further comprises a cavity partially forming the electrohydraulic forming chamber and the electrical insulator forms at least partially a lateral wall of said cavity. Particularly advantageously, the electrical insulator constitutes the lateral wall of the cavity.

A portion of the shock wave propagating towards the back wall of the cavity wherein the central electrode leads, the insulator located on the lateral wall is less stressed than when it surrounds the central electrode and partially forms the back wall of the cavity.

In one embodiment, the end of the peripheral electrode and the mould are in electrical contact and subject to a first electric potential, the central electrode being subject to a second electric potential.

When the peripheral electrode and the mould are in electrical contact, possibly by means of a mould support and/or a blank holder, the central electrode being moreover insulated, it is easy to generate the electrical discharge by connecting the central electrode or the body, if it is in electrical contact with the central electrode, to one of the terminals of an impulse voltage generator and by connecting one of the elements in electrical contact of the peripheral electrode to the other terminal of the impulse voltage generator. The design of the electrohydraulic forming device is therefore easier since the electrical connections with the terminals of the high-voltage impulse generator are not necessarily established at the level of the central and peripheral electrodes.

BRIEF DESCRIPTION OF THE SEVERAL VIEWS OF THE DRAWINGS

Details and advantages of the present invention will become better apparent from the following description, made with reference to the appended drawings wherein.

DETAILED DESCRIPTION

Figure 1A:
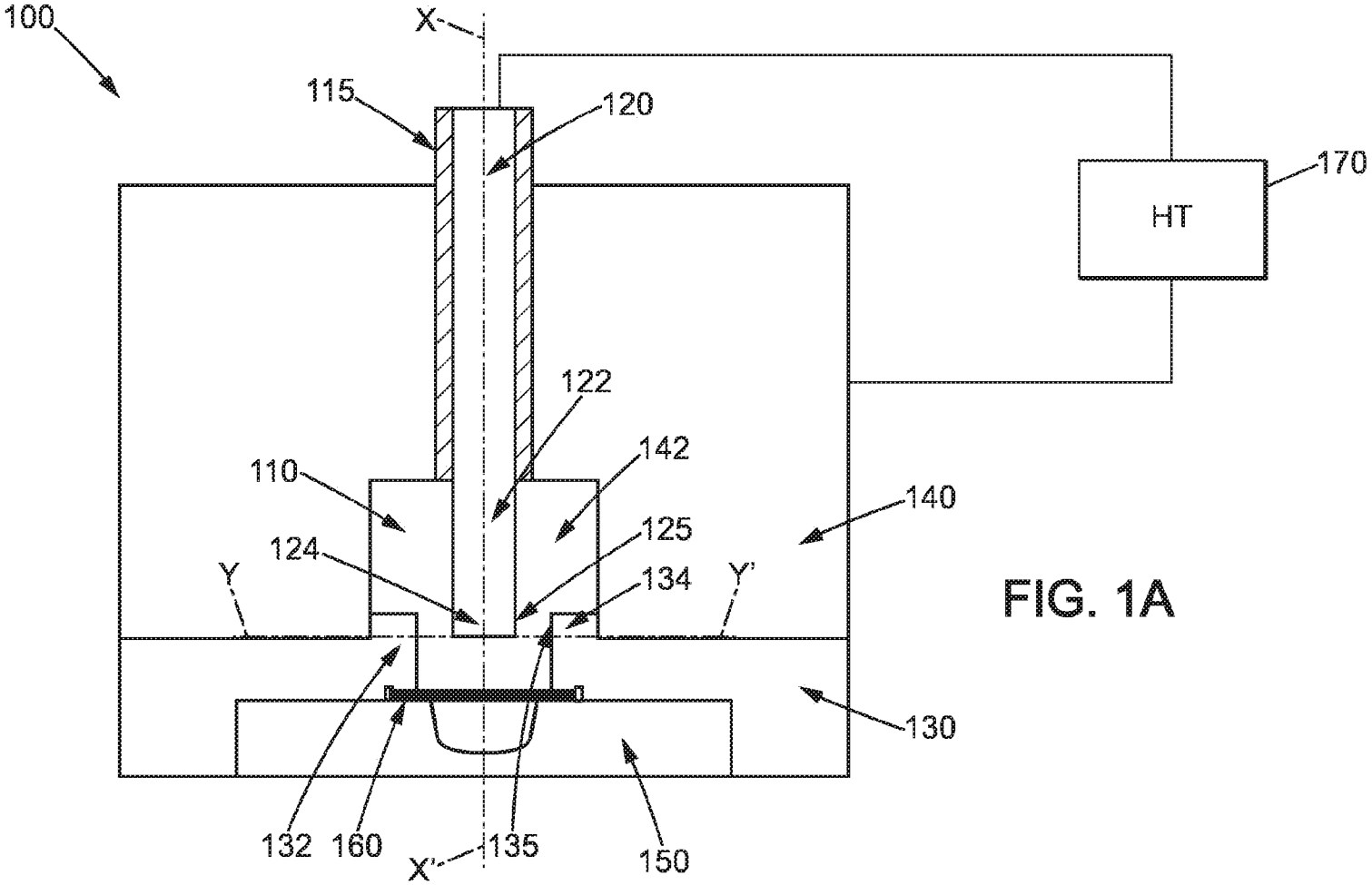
FIG. 1A shows a sectional view of an electrohydraulic forming device according to a first embodiment of the invention.

FIG. 1A shows a first embodiment of an electrohydraulic forming device according to the invention. The electrohydraulic forming device 100 comprises an electrohydraulic forming chamber 110, a central electrode 120 and a peripheral electrode 130. The central electrode 120 extends in a longitudinal direction XX' and comprises a first end 122 arranged inside the electrohydraulic forming chamber 110. The peripheral electrode 130 has an end 132 arranged at a distance from and around the end 122 of the central electrode 120. The end 132 of the peripheral electrode 130 extends in a transverse plane relative to said central electrode 120, that is to say in the plane perpendicular to the axis XX'.

The electrohydraulic forming device 100 also comprises a body 140 and a mould 150. The body 140 comprises an inner cavity 142 and is crossed by the central electrode 120. The inner cavity 142 of the body forms, with the end 132 of the peripheral electrode 130, the electrohydraulic forming chamber 110.

The electrohydraulic forming chamber 110 is intended to be filled with a liquid, for example water, and is sealed by a blank of material 160 to be deformed. The blank of material 160 is pressed against the mould 150 and deforms against the mould 150 by exposure to a shock wave propagating in the electrohydraulic forming chamber 110. The shock wave is generated following the application of a high-voltage electric impulse between the electrodes 120 and 130 and the generation of an electrical discharge between the electrodes. The electrical discharge results in the formation of an electric arc, an increase in temperature and the vaporisation of the liquid causing the creation of the shock wave.

In the embodiment described here, a portion of the end 132 of the peripheral electrode 130 surrounds the lower end 122 of the central electrode 120. An electric arc is preferentially created between two areas 124 and 134, called active parts, of the central electrode 120 and of the peripheral electrode 130 respectively. After each electrical discharge, an electric arc is preferentially created between two different points of the outer surface 125 of the active part 124 of the central electrode 120 and of the inner surface 135 of the active part 134 of the peripheral electrode 130 corresponding to the shortest path between the central electrode 120 and the peripheral electrode 130, respectively. Thus, each electrode wears locally in various points distributed over the outer surface 125 of the active part 124 of the central electrode 120 and over the inner surface 135 of the active part 134 of the peripheral electrode 130. The wear of the peripheral electrode being distributed over a larger surface, the distance between the electrodes varies less than with a device from the prior art wherein two electrodes, the most often conical, are placed face to face and the active parts of which are therefore very localised. Therefore, the electrodes can be used longer without the efficiency of the electrohydraulic forming, and in particular the pressure generated by the shock wave, being affected.

Figure 2:
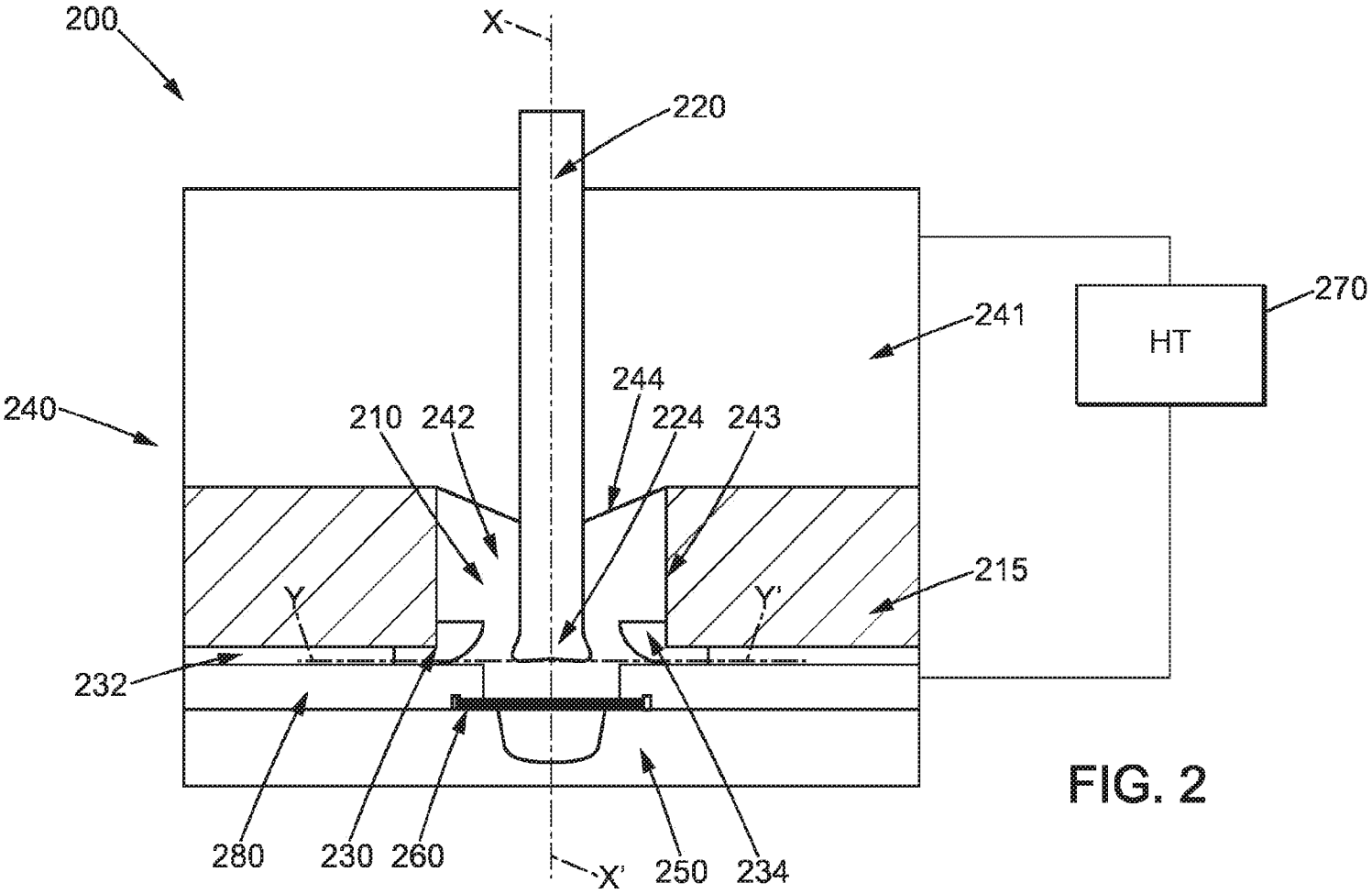
FIG. 2 shows a sectional view of an electrohydraulic forming device according to a second embodiment of the invention.

Moreover, it will be noted that the cross-section of the central electrode is not necessarily formed constant along the longitudinal axis XX' thereof as illustrated for example with reference to FIG. 2. Furthermore, the cross-section of the electrode is not necessarily axisymmetric.

The blank of material 160 is held against the mould 150 by the peripheral electrode 130 (FIG. 1A). To this end, the peripheral electrode 130 also comprises, on the lower face thereof, a shoulder wherein may be lodged the blank of material 160. Therefore, the peripheral electrode 130 serves as a blank holder and makes it possible to hold the blank of material 160 against the mould 150.

Figure 1B:
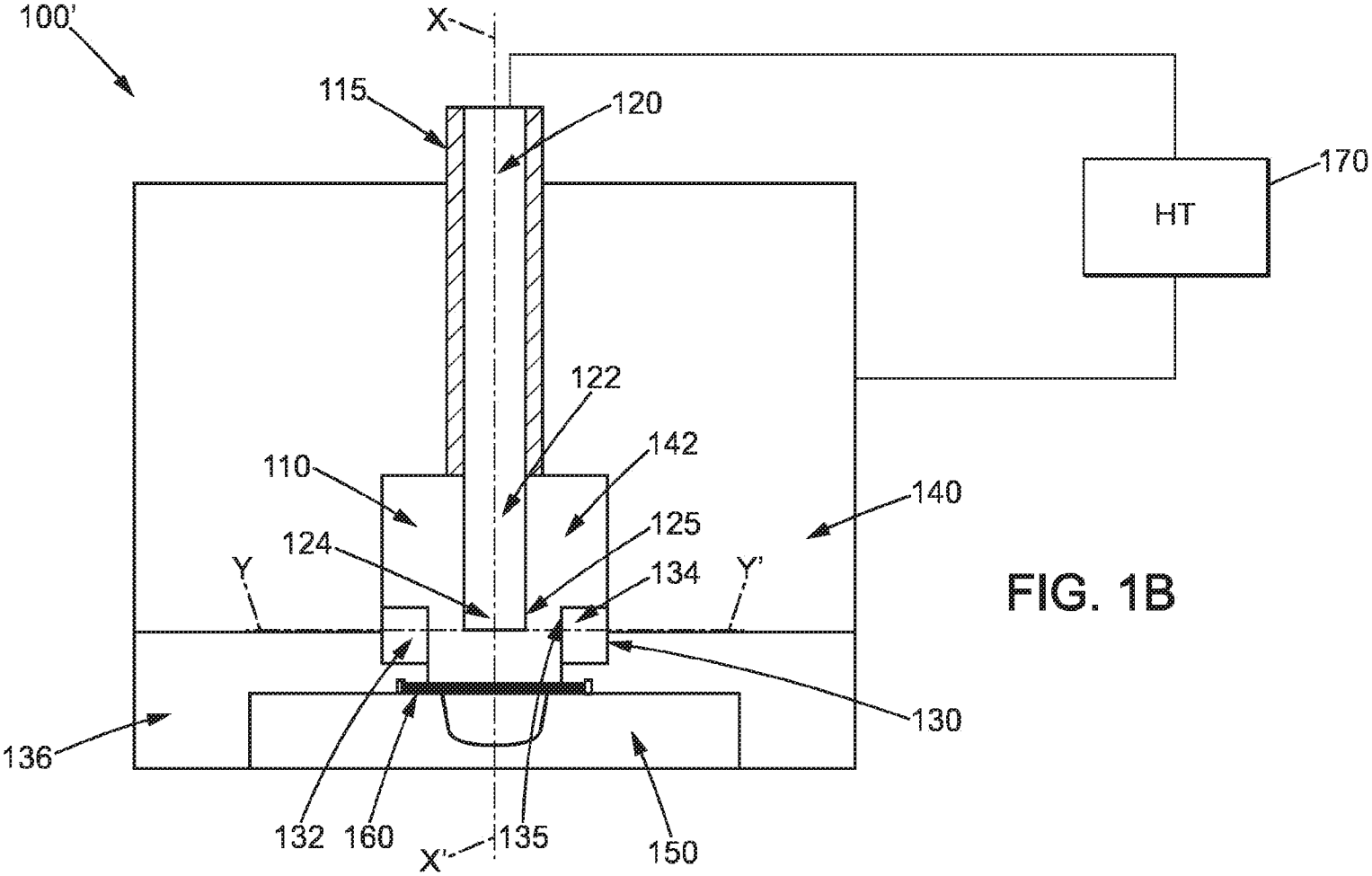
FIG. 1B shows a sectional view of an electrohydraulic forming device according to an alternative embodiment.

In one alternative embodiment shown in FIG. 1B, the electrohydraulic forming device 100', of similar structure as the device shown with reference to FIG. 1A, further comprises an electrode holder 136 supporting the peripheral electrode 130. The electrode holder 136 is arranged between the mould 150 and the body 140. It comprises on the lower face thereof a shoulder wherein may be lodged the blank of material 160 and on the upper face thereof a housing suitable for receiving the peripheral electrode 132. Therefore, the electrode holder 136 also serves as a blank holder for holding the blank of material 160 against the mould 150.

In other alternative embodiments, an additional part 280 may be used in order to serve as a blank holder and hold the blank of material to be deformed against the mould as illustrated with reference to FIG. 2, for example. In said case, the electrode holder 136 does not comprise a shoulder on the lower face thereof.

Moreover, it will be noted that the body 140, the peripheral electrode 130 and the mould 150 are in electrical contact with one another when same are made from a conductive material such as steel, or any other metal alloy. In the embodiment described here, an electrical insulator 115 surrounds the central electrode 120 over a portion of the length thereof at least, in particular over the portion of the central electrode 120 lodged in the body 140. The central electrode 120 is therefore electrically insulated from the peripheral electrode 130, even if the body 140 is in electrical contact with the peripheral electrode 130. The central electrode 120 may therefore be subject to a first electric potential by connecting same to one of the terminals of a high-voltage impulse generator 170 and by connecting the body 140, the peripheral electrode 130 or the mould 150 to the other terminal of the high-voltage impulse generator 170. Said form of implementation of the invention is particularly advantageous because easy to machine and assemble.

It will be noted that the mould 150 may consist of a single piece or be attached on an additional part called mould support, thus making it possible to change the mould more easily depending on the part to be formed.

It will be noted that the various components of the electrohydraulic forming device described here are attached to one another using screws and that seals may be used in order to seal the hydraulic forming chamber, in particular at the level of the central electrode, of the peripheral electrode and of the mould for example. Such means are within the reach of the person skilled in the art and are not described with more details here in the interest of simplification.

Moreover, it will be noted that the manner in which the central electrode is held in the body is not shown. The central electrode may be attached in the electrohydraulic forming device by various means. It may, for example, be held using an additional part (not shown) electrically insulated from the body.

Advantageously, in order to be able to place the blank of material between the peripheral electrode and the mould, the assembly formed by the mould and the peripheral electrode is moveable relative to the body comprising the central electrode and the body is preferentially fixed. The peripheral electrode is therefore attached on the mould. Thus, it is not necessary to move the current-carrying conductors connected to the body when the blank of material to be deformed is changed.

In one alternative embodiment, the mould is mounted on the platform of a press and the peripheral electrode is directly attached on the body. The blank of material is held between the peripheral electrode and the mould when the mould is held against the peripheral electrode using the press.

It will be noted that in the electrohydraulic devices described here and in the present application, the peripheral electrode is easily accessible and may be changed easily.

FIG. 2 shows a second embodiment of an electrohydraulic forming device according to the invention. The electrohydraulic forming device 200 is similar to same shown with reference to FIG. 1A in that it also comprises an electrohydraulic forming chamber 210, a central electrode 220, a peripheral electrode 230, a body 240 and a mould 250. As opposed to the electrohydraulic forming device shown with reference to FIG. 1A, the electrohydraulic forming device 200 further comprises an additional part 280 serving as a blank holder. The device further comprises an electrode holder 232 on which is attached the peripheral electrode 230. The body 240 further comprises an electrical insulator 215 positioned, no longer between the body and the central electrode as illustrated with reference to FIGS. 1A and 1B, but for example, on the lower portion of the body 240. In the embodiment illustrated here, the electrical insulator 215 constitutes the lateral wall 243 of the cavity 240 partially forming the electrohydraulic forming chamber 210. In other alternative embodiments, the electrical insulator 215 may only form a portion of the lateral wall. The central electrode 220 and the upper portion 241 of the body 240 are therefore in electrical contact and the upper portion 241 of the body 240, for example, may be connected to a first terminal of the high-voltage impulse generator 270. The peripheral electrode 230, the electrode holder 232, the blank holder 280 and the mould 250 are in electrical contact and the peripheral electrode 230 is connected to a second terminal of the high-voltage impulse generator 270 by means of the electrode holder 232, of the blank holder 280 or of the mould 250 thus causing an electrical discharge between the central electrode 220 and the peripheral electrode 230. The shock wave thus generated propagates in a plane perpendicular to said discharge. Thus, a portion of the shock wave propagates towards the back wall 244 and impacts said wall, which may damage same. The insulator being located on the lateral wall, same is therefore less stressed, which reduces the risk of damage thereof.

It will be noted that, as in FIG. 1A, the body 240 comprises a cavity 242 and that the lateral wall 243 and the back wall 244 may have various forms suitable for better containment of pressure waves towards the blank of material to be deformed. For example, the back wall 244 may be inclined such as to better reflect the shock waves towards the blank of material to be deformed.

It will also be noted that the active part 224 of the central electrode 220 and the active part 234 of the peripheral electrode 230 are not necessarily of constant cross-section and/or axisymmetric as illustrated with reference to FIG. 2.

In the embodiments described with reference to FIGS. 1A, 1B and 2, the electrohydraulic forming devices only comprise one central electrode and one peripheral electrode.

In other embodiments, the electrohydraulic forming device may comprise a plurality of pairs of central and peripheral electrodes combined with one or more moulds. Thus, it is possible to produce a plurality of parts in parallel or one large part by implementing at the same time a plurality of electrical discharges.

In the case of parts to be formed of large dimensions, it may be advantageous also to use a plurality of central electrodes combined with a single peripheral electrode. By producing a plurality of simultaneous or delayed electrical discharges at various locations, it is possible to produce electrohydraulic forming that is more homogeneous or more progressive or deeper.

Various forms of electrodes and various arrangements of central electrodes are illustrated with reference to FIGS. 3A to 3D.

FIGS. 3A to 3D illustrate more specifically the active parts of central and peripheral electrodes shown in sectional view along a plane (YY', ZZ') perpendicular to the longitudinal axis XX' of a central electrode.

Figure 3A:
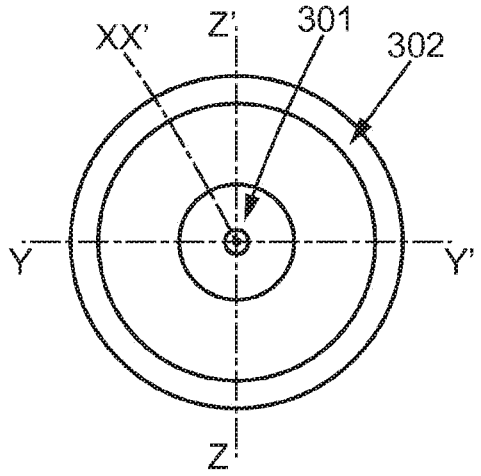
FIGS. 3A, 3B, 3C and 3D show a sectional view of the active parts of various central and peripheral electrodes according to various alternative embodiments.

In FIG. 3A, the active part 301 of the central electrode is of circular shape and the active part 302 of the peripheral electrode has the shape of a circular ring.

Figure 3B:
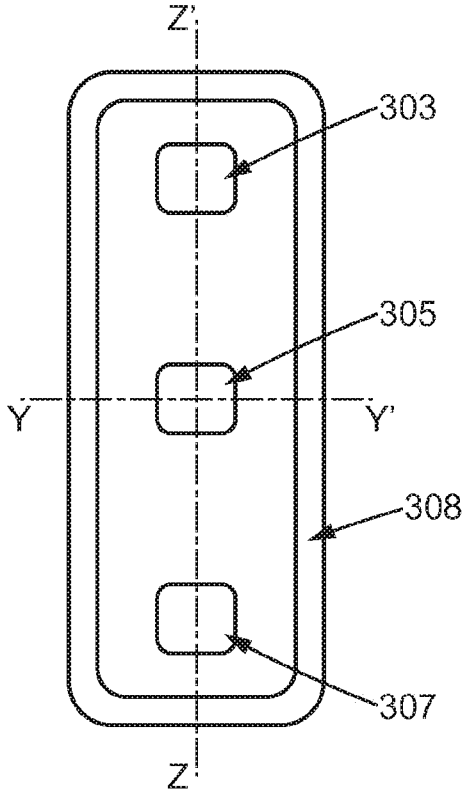

In FIG. 3B, the active parts 303, 305, 307 of a plurality of central electrodes are of rectangular cross-section, preferentially with rounded corners, and aligned in a common direction ZZ' at the centre of a rectangular-shaped ring forming the active part 308 of the corresponding peripheral electrode.

Figure 3C:
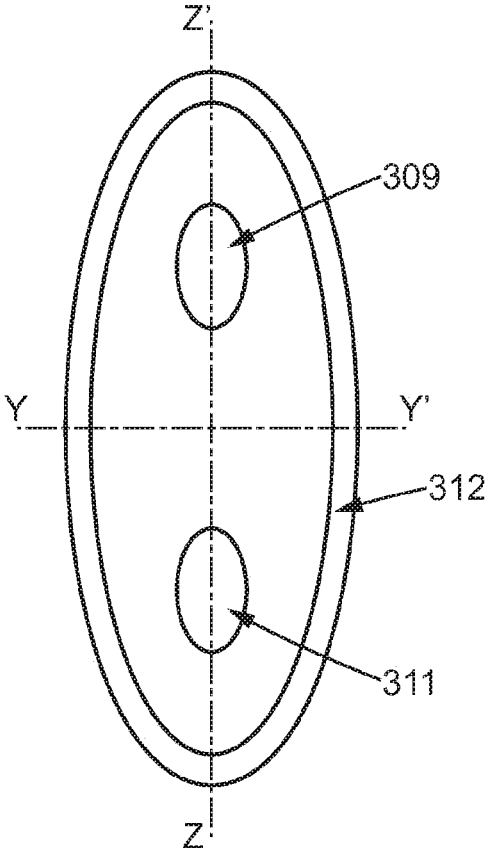

In FIG. 3C, the active parts 309, 311 of a plurality of central electrodes are of elliptical cross-section, and aligned in a common direction ZZ' at the centre of an elliptical-shaped ring forming the active part 312 of the corresponding peripheral electrode.

Figure 3D:
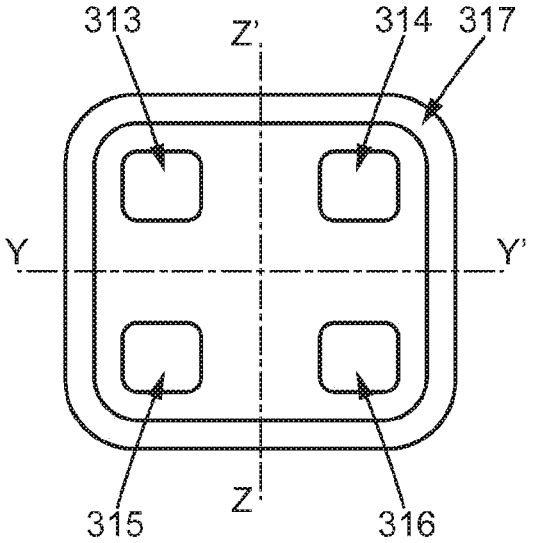

In FIG. 3D, the active parts 313, 314, 315, 316 of four central electrodes are of square rectangular cross-section, preferentially with rounded corners, and are arranged inside a square-shaped ring forming the active part 317 of the corresponding peripheral electrode.

The peripheral electrodes described here are formed from a single part. In one alternative embodiment, the peripheral electrodes comprise various separate sections intended to be placed opposite each central electrode to generate discharges. These various sections therefore comprise the active parts of the peripheral electrode. Thus, the costs of replacing peripheral electrodes are reduced by only replacing some sections. It will be noted that other geometric shapes may also be used in the event that the distance between the outer surface of the active part of the central electrode considered and the inner surface of the active part of the neighbouring peripheral electrode are substantially equidistant on at least one portion of the surfaces of the active parts considered in the plane.

As previously discussed with reference to FIG. 2, the cross-section of the active parts of the electrodes may be constant or vary according to the longitudinal direction thereof shown by the axis XX' in FIGS. 1A, 1B and 2.

The various embodiments of an electrohydraulic forming device described above make the electrohydraulic forming of blanks of material possible with a peripheral electrode partially surrounding a central electrode, the peripheral electrode being separate from the body partially forming the electrohydraulic forming chamber. The electrical discharge is therefore distributed around the periphery of the active parts of the electrodes. The peripheral electrode, which has a larger contact surface, wears more slowly. Thus, the distance between the electrodes does not vary much, which makes it possible to maintain the efficiency of the electrohydraulic forming by keeping substantially constant a pressure generated by the electrical discharge. However, when the electrodes must be changed, the peripheral electrode may, advantageously, be easily changed when the electrohydraulic forming device is opened for placing the blank of material, the peripheral electrode being separate from the body and the blank of material preferentially being placed between the peripheral electrode and the mould. Advantageously, the central electrode may be moved along the longitudinal axis thereof in order to present to the peripheral electrode a less degraded active part.

The present invention is not limited to the various embodiments described and illustrated and to the alternative embodiments mentioned but also relates to the embodiments within the reach of the person skilled in the art within the scope of the claims hereafter.

The invention claimed is:

1. An electrohydraulic forming device configured to form a blank of material comprising:

an electrohydraulic forming chamber;

a first central electrode extending in a longitudinal direction and comprising an end arranged inside the electrohydraulic forming chamber;

a peripheral electrode electrically insulated from the first central electrode, the peripheral electrode having an end arranged at a distance from and around the end of the first central electrode, said end of the peripheral electrode extending in a transverse plane relative to the longitudinal direction of said first central electrode, the peripheral electrode protruding inside the electrohydraulic forming chamber;

a body provided with a bore for introducing the first central electrode into the electrohydraulic forming chamber, the electrohydraulic forming chamber being partially formed by said body; and a mould, wherein the peripheral electrode is separate from said body.

2. The electrohydraulic forming device according to claim 1, wherein the peripheral electrode is protruding relative to the body.

3. The electrohydraulic forming device according to claim 1, further comprising an electrode holder supporting the peripheral electrode.

4. The electrohydraulic forming device according to claim 1, wherein the peripheral electrode is the only peripheral electrode of the electrohydraulic forming device, the electrohydraulic forming device further comprising a second central electrode surrounded by the peripheral electrode.

5. The electrohydraulic forming device according to claim 1, wherein the electrohydraulic forming chamber is formed by the body and by the end of the peripheral electrode.

6. The electrohydraulic forming device according to claim 1, further comprising an electrical insulator surrounding a portion of the first central electrode.

7. The electrohydraulic forming device according to claim 1, wherein the body is in electrical contact with the first central electrode and the electrohydraulic forming device further comprises an electrical insulator that insulates the peripheral electrode from the first central electrode.

8. The electrohydraulic forming device according to claim 7, wherein the body further comprises a cavity partially forming the electrohydraulic forming chamber and the electrical insulator forms at least partially a lateral wall of said cavity.

9. The electrohydraulic forming device according to claim 8, wherein the electrical insulator constitutes the lateral wall of the cavity.

10. The electrohydraulic forming device according to claim 1, further comprising a mould support.

11. The electrohydraulic forming device according to claim 1, the peripheral electrode and the mould are configured to hold the blank of material.

12. The electrohydraulic forming device according to claim 1, further comprising a blank holder arranged between the peripheral electrode and the mould.

13. The electrohydraulic forming device according to claim 1, wherein the peripheral electrode and the mould are in electrical contact and subject to a first electric potential, the first central electrode being subject to a second electric potential.

* * * * *